US011345446B2

(12) United States Patent
Wilson et al.

(10) Patent No.: US 11,345,446 B2
(45) Date of Patent: May 31, 2022

(54) WINDSCREEN FOR BOATS

(71) Applicant: Great Lakes Boat Top LLC, Vonore, TN (US)

(72) Inventors: Jim Wilson, Loudon, TN (US); Melvin W. McInerney, Loudon, TN (US)

(73) Assignee: Great Lakes Boat Top LLC, Vonore, TN (US)

( * ) Notice: Subject to any disclaimer, the term of this patent is extended or adjusted under 35 U.S.C. 154(b) by 12 days.

(21) Appl. No.: 17/096,375

(22) Filed: Nov. 12, 2020

(65) Prior Publication Data

US 2021/0188400 A1 Jun. 24, 2021

Related U.S. Application Data

(60) Provisional application No. 62/950,512, filed on Dec. 19, 2019.

(51) Int. Cl.
*B63B 19/02* (2006.01)
*B63B 29/04* (2006.01)

(52) U.S. Cl.
CPC ..... *B63B 19/02* (2013.01); *B63B 29/04* (2013.01)

(58) Field of Classification Search
CPC ..... B63B 19/02; B63B 29/04
See application file for complete search history.

(56) References Cited

U.S. PATENT DOCUMENTS 1,285,392 A * 11/1918 Robertson ..... B63B 17/02 114/361
5,918,613 A * 7/1999 Larson ..... B63B 17/02 135/141
6,647,915 B1 * 11/2003 Bach ..... B63B 19/02 114/361
8,936,296 B1 * 1/2015 Fedders ..... B60J 1/06 296/85
9,815,412 B1 * 11/2017 Tsumiyama ..... B60J 1/006
11,203,253 B2 * 12/2021 Nakaji ..... B60J 1/06
2007/0215031 A1 * 9/2007 Bach ..... B63B 17/02 114/361
2012/0074282 A1 * 3/2012 Willey ..... B60J 1/004 29/525.02
2014/0261143 A1 * 9/2014 Williams ..... B63B 17/02 114/361
2018/0009509 A1 * 1/2018 Forbes ..... F16J 15/025
2021/0024176 A1 * 1/2021 Becke ..... B63B 19/02

OTHER PUBLICATIONS

Extreme Metal Products—UTV windshield—product was publicly available prior to Oct. 2019.

* cited by examiner

*Primary Examiner* — S. Joseph Morano
*Assistant Examiner* — Jovon E Hayes
(74) *Attorney, Agent, or Firm* — Luedeka Neely Group, P.C.

(57) ABSTRACT

A boat having a windscreen attached to the boat without the use of tools. The boat has a T-top including a canopy supported in an elevated position by an upright support fixed to the boat. A rigid boat windscreen having a plurality of clamps is mounted to the rigid boat windscreen and also mounted to the upright support. The clamps are mounted to the support manually without the use of tools and the clamps each include a mount secured to the rigid screen and a C-shaped, flexible portion connected to the mount and positioned about the support.

4 Claims, 5 Drawing Sheets

WINDSCREEN FOR BOATS

FIELD

The present disclosure relates to windscreens. More particularly, the disclosure relates to windscreens for boats, and in particular windscreens for use with T-top boats.

BACKGROUND

Improvement is desired in windscreens for boats, and in particular, windscreens for use with boats having a top, and especially having a T-top. With reference to FIG. 1, which depicts a prior art T-top T, T-tops are typically provided by a canopy C supported in an elevated position by supports such as upright tubular supports S fixed to a floor of a boat B or a center console CC of the boat B.

It is often desirable to have a rigid windscreen or windshield on a boat, especially in rough water conditions or when traveling at high speed. However, other times it is desirable to not have a windscreen. Rigid windscreens, generally glass, are typically semi-permanently installed using tools and are not easily removable. This is inconvenient and cumbersome, especially during use of a boat where there are times when a windscreen is desired and times when it is desirable to not have a windscreen. To counter this, non-rigid plastic windscreens that can be rolled up and the like are used. These non-rigid windscreens are poor substitutes for a rigid windscreen. Thus, what is desired is a rigid windscreen structure that may be easily and securedly installed and removed without the use of tools.

SUMMARY

The disclosure advantageously provides a rigid windscreen structure for boats that may be easily and securedly installed and removed without the use of tools.

In one aspect, the disclosure provides a boat having a windscreen attached to the boat without the use of tools. The boat has a T-top including a canopy supported in an elevated position by an upright support fixed to the boat. A rigid boat windscreen having a plurality of clamps is mounted to the rigid boat windscreen and also mounted to the upright support. The clamps are mounted to the support manually without the use of tools. The clamps each include a mount secured to the rigid screen and a C-shaped portion connected to the mount and positioned about the support.

In another aspect, the boat includes a center console with an upright support, and a rigid boat windscreen having a plurality of clamps mounted to the rigid boat windscreen and also mounted to the upright support. The clamps are mounted to the support without the use of tools. The clamps each include a mount secured to the rigid screen and a C-shaped portion connected to the mount and positioned about the support.

BRIEF DESCRIPTION OF THE DRAWINGS

Further advantages of the disclosure are apparent by reference to the detailed description when considered in conjunction with the figures, which are not to scale so as to more clearly show the details, wherein like reference numbers indicate like elements throughout the several views, and wherein.

DETAILED DESCRIPTION

Figure 1:
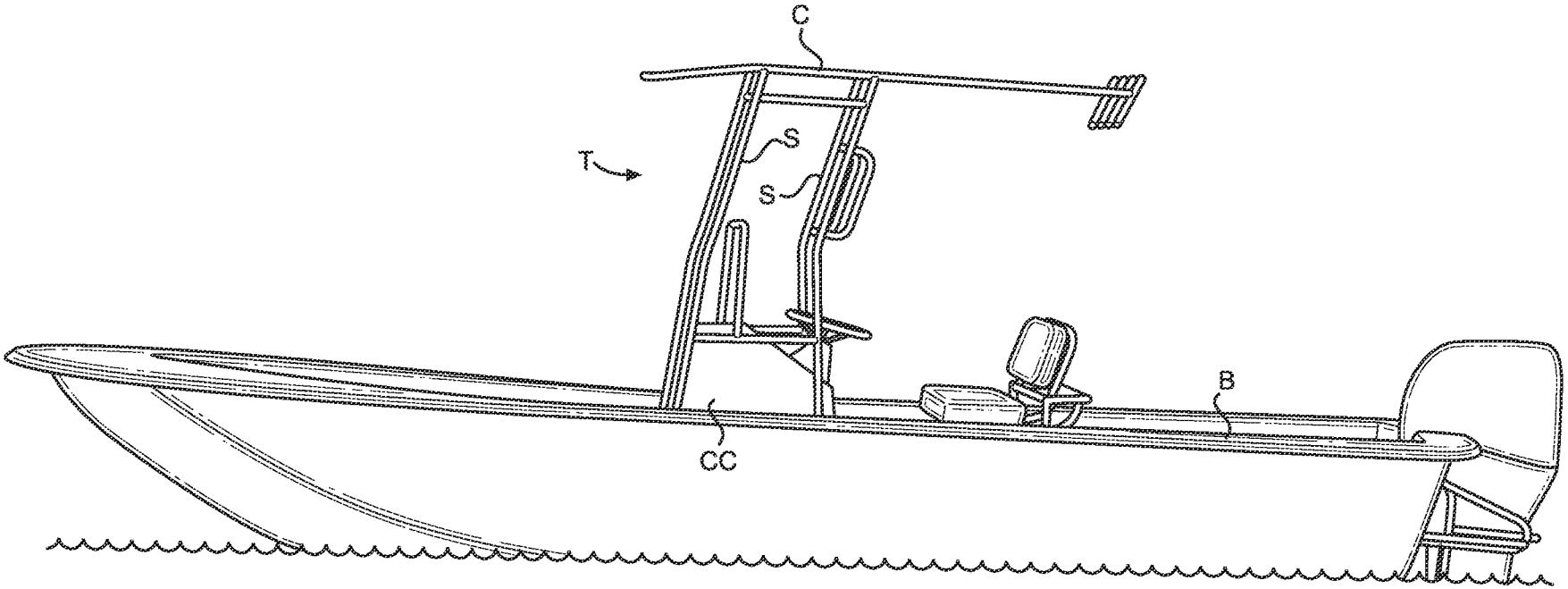
FIG. 1 PRIOR ART
FIG. 1 shows a prior art boat having a T-top.
Figure 2:
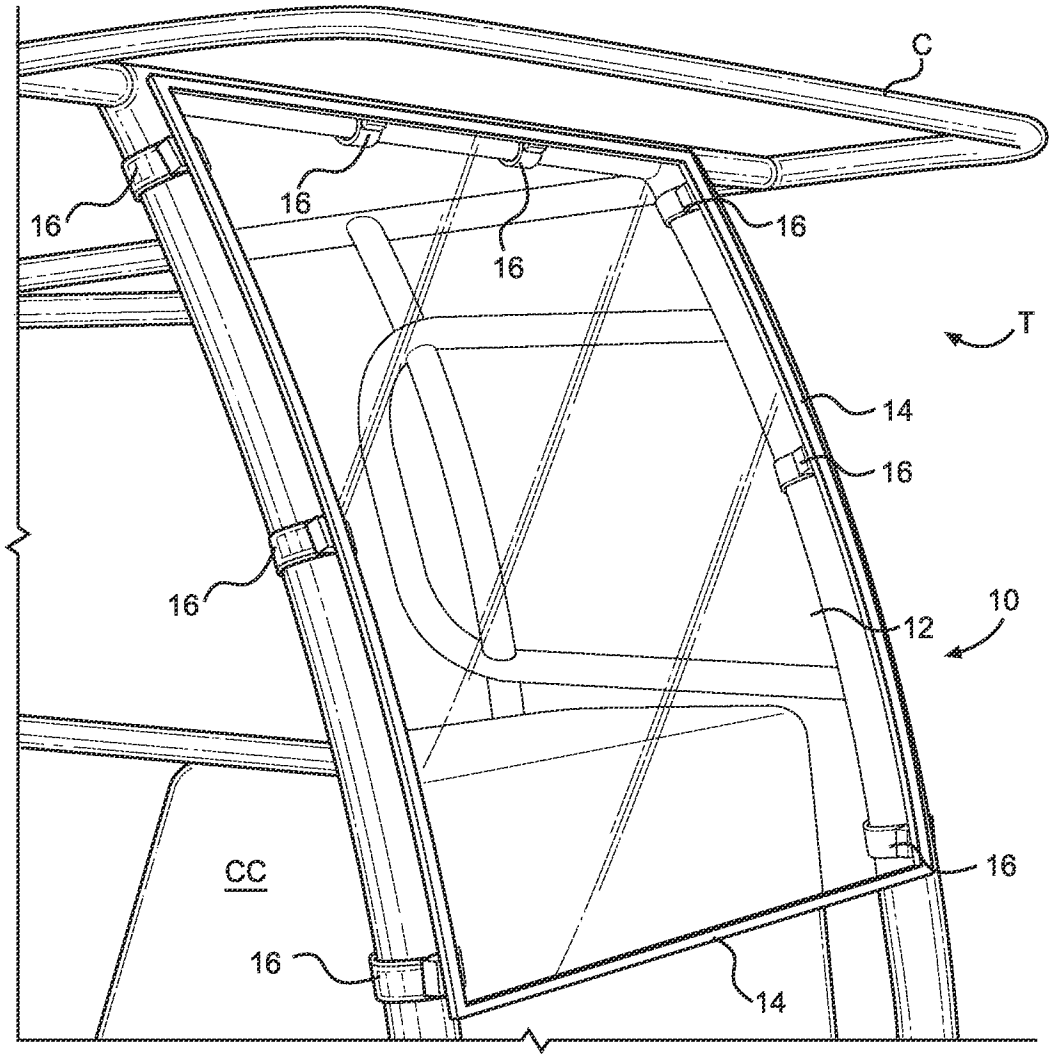
FIG. 2 shows a windscreen according to the disclosure installed on the T-top of the boat.

With initial reference to FIG. 2, there is shown a windscreen 10 according to the disclosure installed on the T-Top T of the boat B. The windscreen 10 has as components a rigid screen 12, bumper 14, and clamps 16. The clamps 16 are attached to the rigid screen 12 to provide structure for installing the windscreen 10. Thus, it will be understood that the windscreen 10 is configured to provide a rigid windscreen structure that may be easily and securedly installed and removed manually without the use of tools, and is particularly configured for installation onto the boat B having the T-Top T.

Figure 3:
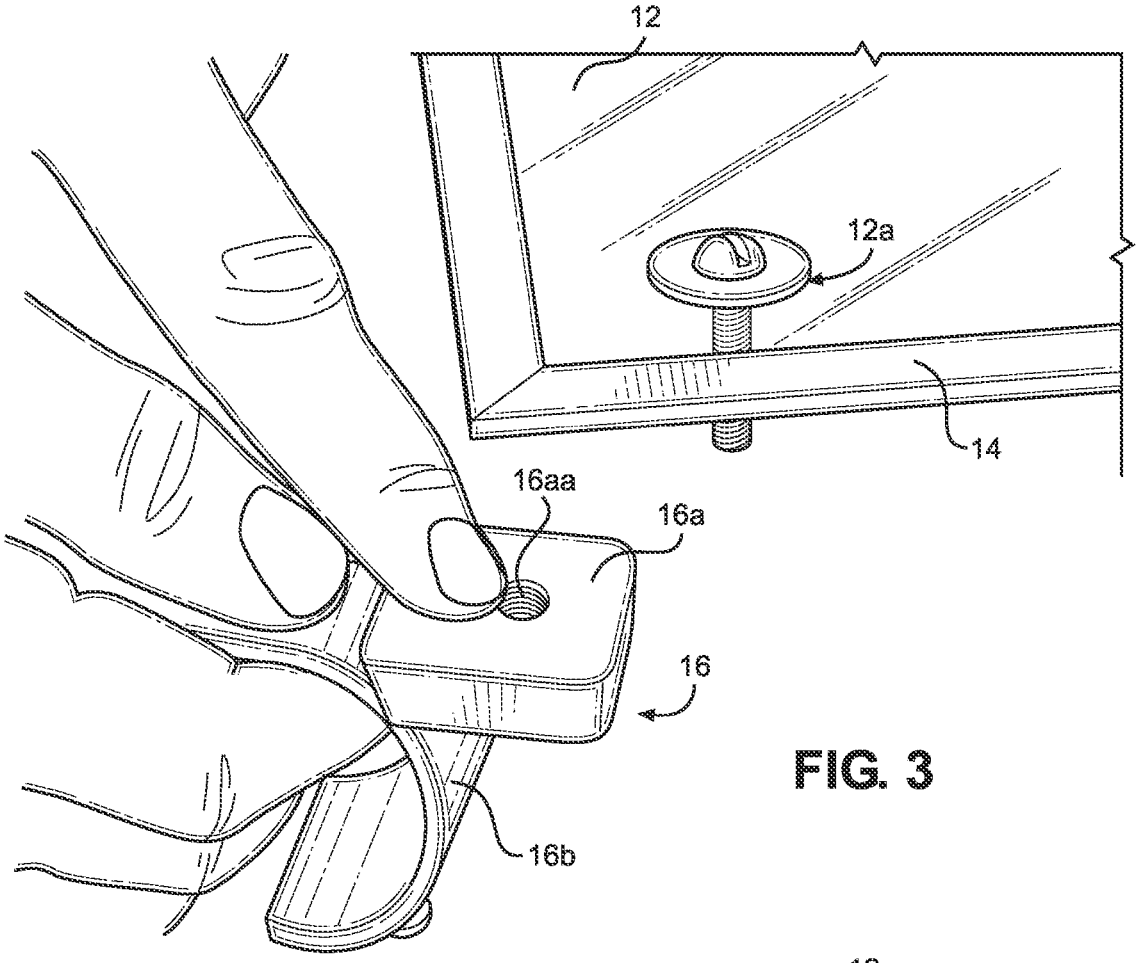
FIGS. 3-5 show installation of a clamp component of the windscreen.
Figure 4:
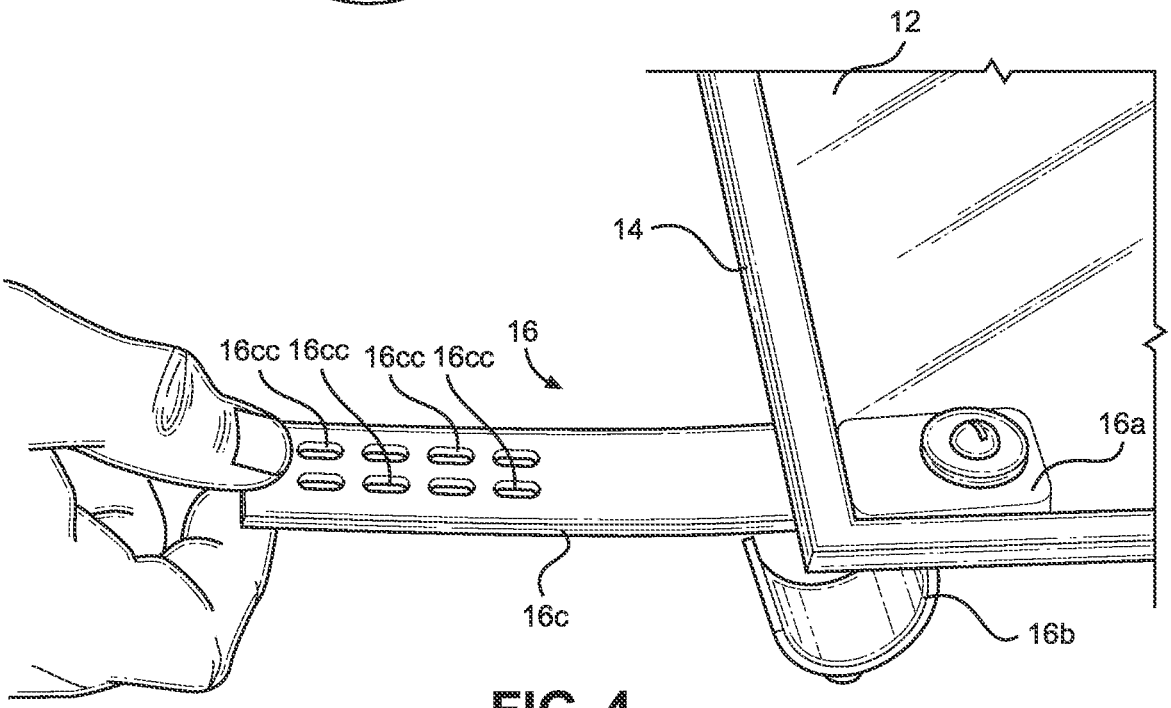
Figure 5:
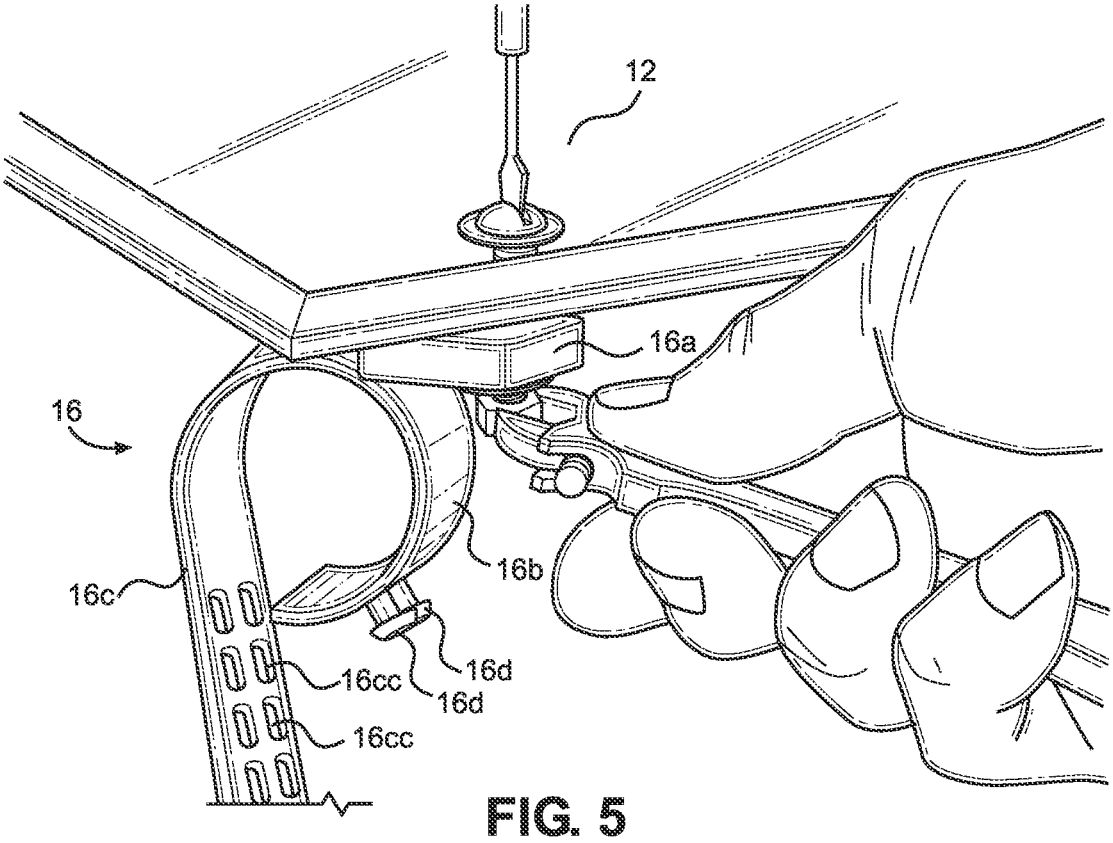

The rigid screen 12 is a rigid transparent member such as a plate of windshield glass or polymeric material suitable for use as a boat windshield. The rigid screen is typically planar and square or rectangular in configuration. However, the rigid screen 12 may be curved and shaped in other configurations. Apertures 12*a* may be drilled or formed through rigid screen 12 for installation of the clamps 12 (FIGS. 3 and 7).

The bumper 14 is preferably installed around the perimeter edges of the rigid screen 12 to protect the edges from impact. The bumper 14 is preferably formed of rubber or like material and may be formed in the manner of a gasket to friction fit onto the edges of the windscreen 12. Alternatively, the bumper 14 may be adhesively secured to the edges.

Figure 6:
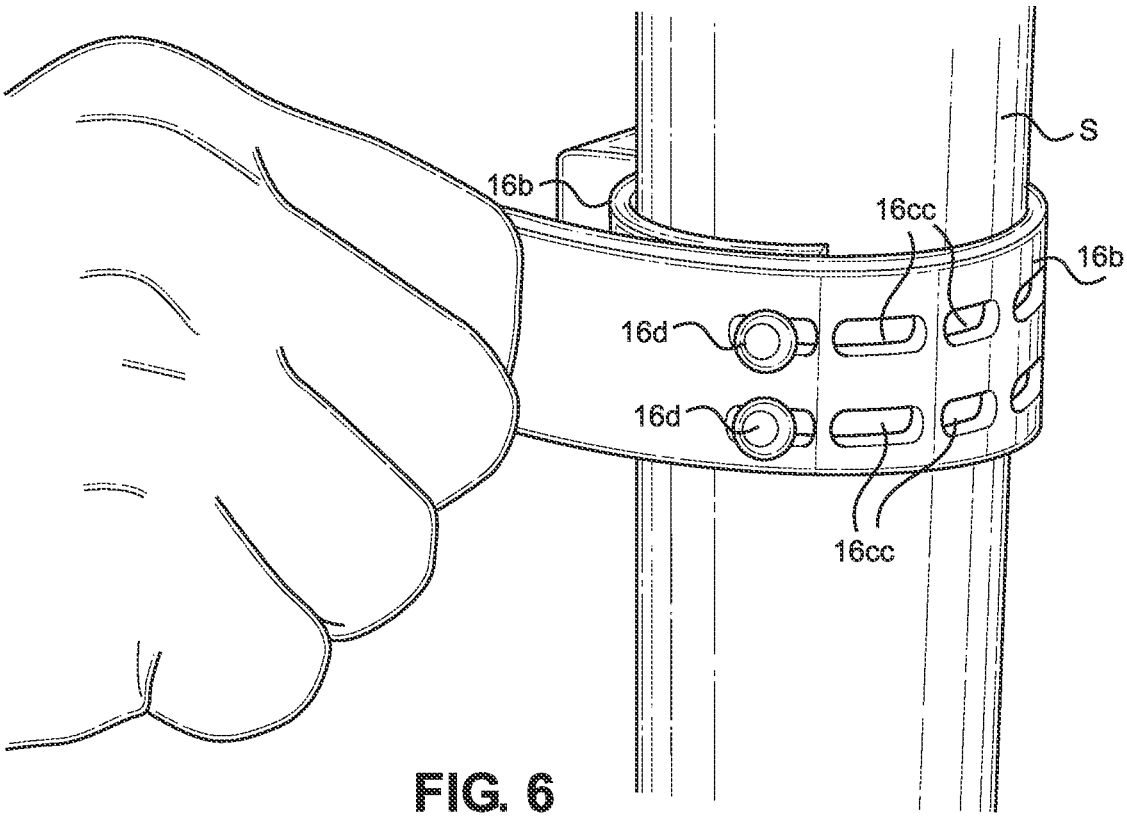
FIG. 6 shows the manner of installation of the clamp onto a support of the T-top without the use of tools.
Figure 7:
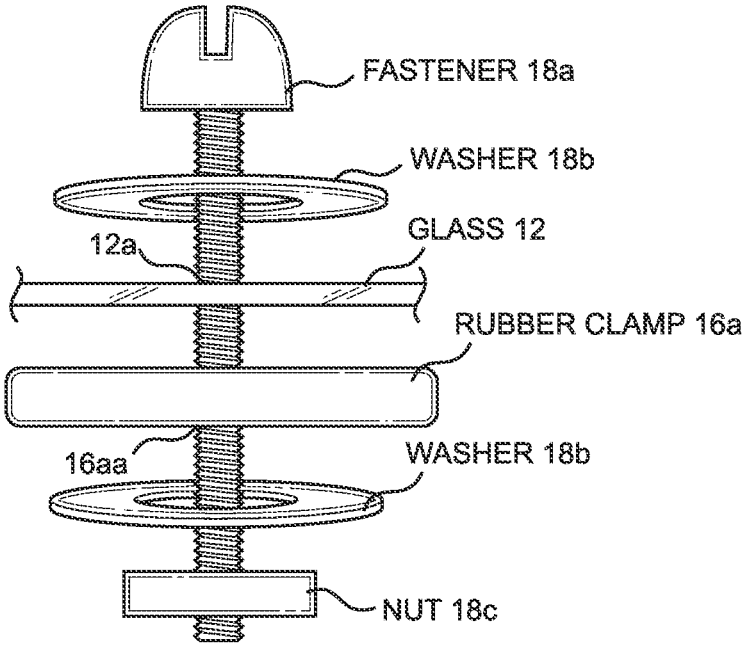
FIG. 7 depicts additional parts used to install the clamp onto the windscreen.

With additional reference to FIGS. 3-7, the clamps 16 are desirably made of a pliable material such as rubber or rubberized plastic and are desirably of one-piece construction. Each clamp 16 includes a mount 16*a* which is a generally planar portion configured to be secured to the windscreen 12 and includes a mounting aperture 16*aa*. As seen in FIG. 7, to mount the clamp 16*s* to the rigid screen 12, the mount 16*a* is placed against the screen 12 and mounting apertures 16*aa* are aligned with the apertures 12*a* of the screen 12. A fastener 18*a* is passed through the aligned apertures 12*a* and 16*aa* and secured in place as by use of washers 18*b* and nut 18*c*. This provides the structure of the windscreen 10 having the clamps 16 attached thereto. The windscreen 10 may be quickly and easily attached to or removed from the supports S of the T-top T using the clamps 16 without the use of tools.

In this regard, the clamps 16 also include a C-shaped portion 16*b* connected to the mount 16*a* and having a free end 16*c* extending from one of the edges of the C-shaped portion 16*b* and having uniformly spaced apart apertures 16*cc* along at least a portion of the length of the free end 16*c*. The apertures 16*cc* are configured to engage pegs 16*d* located on an exterior surface of the C-shaped portion 16*b* opposite the free end 16*c*.

As shown in FIG. 6, the C-shaped portion 16*b* is placed around the support S of the T-top T and the free end 16*c* is stretched to tension around the support S and the apertures 16*cc* are engaged with the pegs 16*d* to maintain this tension and thereby secure the clamp 16 to the support S of the T-top T. This is done for each of the clamps 16, preferably starting with the uppermost clamps 16. Thus, the clamps 16 enable the screen 12 to be quickly and securely mounted to or removed from the supports S manually and without the use of tools.

The foregoing description of preferred embodiments for this disclosure has been presented for purposes of illustration and description. It is not intended to be exhaustive or to limit the disclosure to the precise form disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the disclosure in various embodiments and with various modifications as are suited to the particular use contemplated.

The invention claimed is:

1. A boat having a windscreen attached to the boat without the use of tools, the boat and windscreen comprising:

a boat having a T-top including a canopy supported in an elevated position by an upright support fixed to the boat; and a rigid boat windscreen having a plurality of clamps mounted to the rigid boat windscreen and also mounted to the upright support, the clamps being mounted to the support manually without the use of tools and the clamps each comprising a mount secured to the rigid screen and a C-shaped portion connected to the mount and positioned about the support;

wherein the C-shaped portion of the clamps includes a free end extending from one of the edges of the C-shaped portion and secured to a portion of the C-shaped portion opposite the free end;

and further wherein the free end has uniformly spaced apart apertures along the length of the free end, and pegs located on a portion of the C-Shaped portion opposite the free end, the apertures on the free end engaging the pegs.

2. The boat of claim 1, further comprising a bumper installed around perimeter edges of the rigid boat windscreen.

3. A boat having a windscreen attached to the boat without the use of tools, the boat and windscreen comprising:

a boat having a center console with an upright support; and a rigid boat windscreen having a plurality of clamps mounted to the rigid boat windscreen and also mounted to the upright support, the clamps being mounted to the support manually without the use of tools and the clamps each comprising a mount secured to the rigid screen and a C-shaped portion connected to the mount and positioned about the support;

wherein the C-shaped portion of the clamps includes a free end extending from one of the edges of the C-shaped portion and secured to a portion of the C-shaped portion opposite the free end;

and further wherein the free end has uniformly spaced apart apertures along the length of the free end, and pegs located on a portion of the C-Shaped portion opposite the free end, the apertures on the free end engaging the pegs.

4. A boat having a windscreen attached to the boat without the use of tools, the boat and windscreen comprising:

a boat having a T-top including a canopy supported in an elevated position by an upright support fixed to the boat; and a rigid boat windscreen having a plurality of clamps mounted to the rigid boat windscreen and also mounted to the upright support, the clamps being mounted to the support manually without the use of tools and the clamps each comprising a mount secured to the rigid screen and a flexible portion connected to the mount and positioned about the support in a tensioned condition, wherein a free end of the flexible portion has uniformly spaced apart apertures along a length of the free end, and pegs are located on a portion of the flexible portion opposite the free end, and wherein apertures on the free end engage the pegs.

* * * * *